United States Patent [19]

Sena

[11] 4,023,711

[45] May 17, 1977

[54] EXTENSION ARM FOR PAINT SPRAYING DEVICES

[76] Inventor: Ernest H. Sena, 510 1/2 S. Magnolia, Monrovia, Calif. 91790

[22] Filed: Nov. 18, 1975

[21] Appl. No.: 632,965

[52] U.S. Cl. ..... 222/174; 239/532

[51] Int. Cl.[2] ..... B05B 15/06

[58] Field of Search ..... 222/174, 180; 239/280, 239/280.5, 281, 375, 532

[56] References Cited

UNITED STATES PATENTS

| | | | |
|---|---|---|---|
| 1,745,972 | 2/1930 | Beck | 239/532 |
| 1,849,511 | 3/1932 | Thompson | 239/532 X |
| 3,856,209 | 12/1974 | Hickson | 222/174 X |

*Primary Examiner*—Drayton E. Hoffman
*Assistant Examiner*—David A. Scherbel
*Attorney, Agent, or Firm*—Boniard I. Brown

[57] ABSTRACT

A paint spray gun is locked into a receptacle at the free end of a tubular arm pivoted at one end of an elongated tubular stock. The spray gun trigger is engaged by an operating finger, spring-biased toward the 'off' position, which is operated by means of a sheathed, flexible cable through an operating lever mounted at the end of the stock farthest from spray gun receptacle. The relative angular position of the receptacle-bearing arm and the stock is adjustable. A quick-release receptacle is provided to permit the removal and reassembly of the spray gun to the extension arm with facility.

7 Claims, 4 Drawing Figures

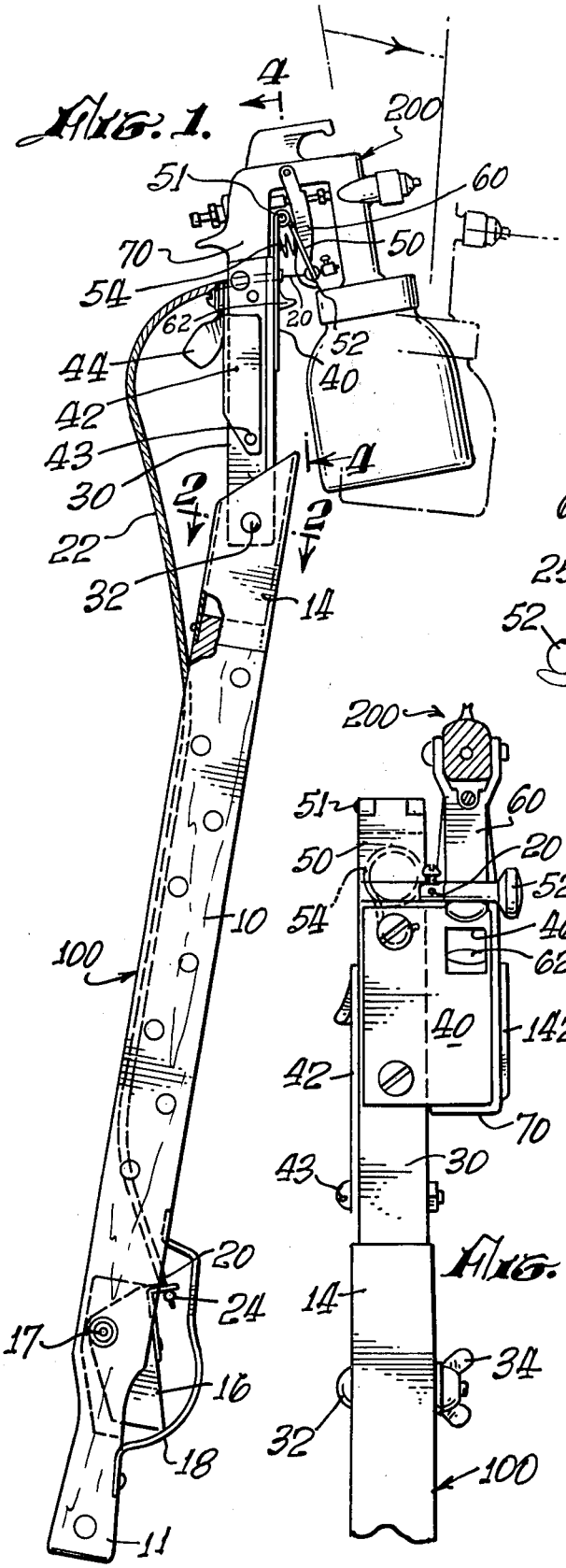
FIG. 1.
4
200
51
60
70
50
54
62
20
52
44
40
42
43
30
4
2
2
22
32
14
10
100
20
24
17
16
18
11
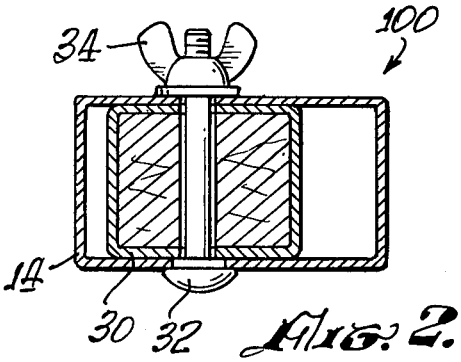
34
100
14
30
32
FIG. 2.
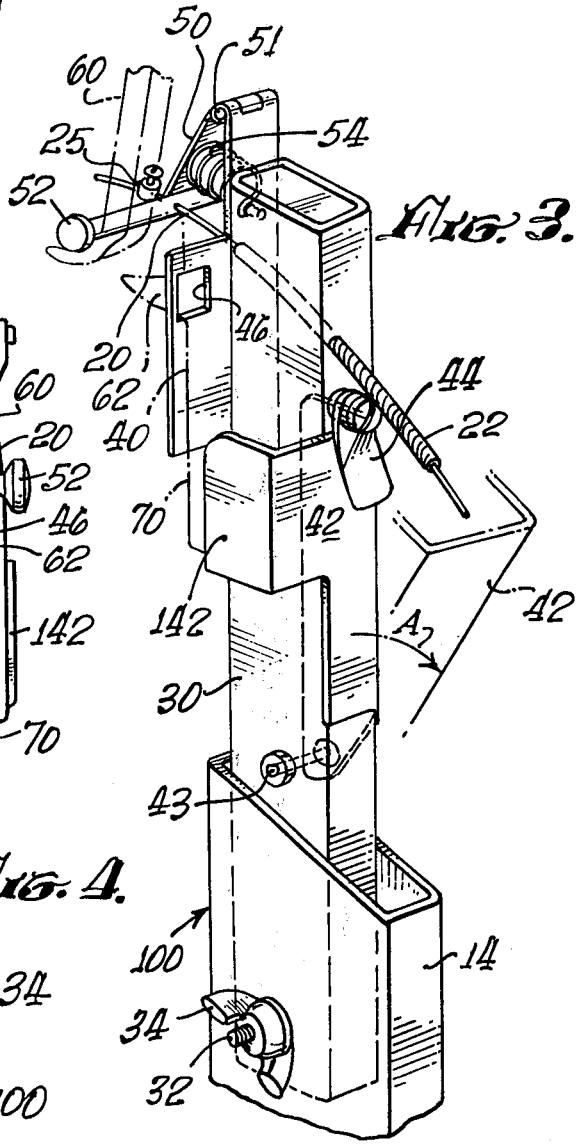
50
51
60
54
25
52
FIG. 3.
46
20
62
40
44
22
70
42
142
42
A
30
43
100
14
34
32
200
51
60
50
20
52
54
46
62
40
142
42
70
43
30
14
34
32
100
FIG. 4.

EXTENSION ARM FOR PAINT SPRAYING DEVICES

BACKGROUND OF THE INVENTION

The instant invention relates to extension arms for spray paint apparatus; it relates, more particularly, to such an extension arm suitable for use with any type of paint spray gun built for manual use, independent of the method of delivering the painting medium to the atomizing and dispensing nozzle.

In the application of paint to surfaces and objects, the use of manual paint spray apparatus, generally referred to as "guns" is common; the use ranging from painting the interior and exterior surfaces of buildings to the application of protective coatings to small manufactured articles. In many such uses it becomes desirable to reach through openings, or into the upper or lower extremities of spaces, where the human arm is not sufficient extension to the spray gun proper.

The prior art has provided a number of solutions to this need and teachings toward spray gun extensions may be found, for example, in U.S. Pat. Nos. 1,511,361 (to Paasche), 1,745,972 (to Beck) and 1,849,511 (to Thompson). In general such extensions are taught in the prior art are adaptable only to particular types of spray apparatus and incorporate components of such specific devices in their assemblies. Others cannot provide for variation in the angular position of the spray stream with respect to the extension handle and none have been sufficiently light, simple, and economical to find widespread distribution in the trade.

It is, therefore, a primary object of the invention to provide an extension arm for spray paint apparatus which is adapted to receive any type of spray gun, is adjustable as to spraying angle, from which the gun may be detached simply and easily, and which may be manufactured and maintained with economy and ease.

SUMMARY OF THE INVENTION

The invention attains the above objects, and other objects and advantages which will become apparent in the detailed description of the preferred embodiment thereof below, by providing a novel extension arm assembly including a stock, a pivoting spray gun receptacle arm, and cable-actuated means for operating the control lever integral with the gun proper.

The stock is suitably an elongated tube, of rectangular section by preference, and it receives the pivoting spray-gun receptacle arm at one end. Locking means are provided to secure the arm at a desired angle with respect to the stock. The receptacle itself is of such construction that it will engage any spray gun handle, commonly formed in the shape of a pistol grip; it also incorporates hinged finger means to operate the control switch or trigger on the spray gun.

The mechanical trigger-operating finger moves in response to inputs from an operating lever pivoted at the lower end, opposite to the receptacle end, of the stock.

The length of the stock is variable depending on the desired reach and service conditions. A length of three to four feet will, in general, serve most purposes commonly encountered in manual spraying. Such a length, for example, will permit a spray gun operator to apply paint to a ceiling without recourse to a ladder or other elevating device.

Spray guns have hoses and/or cables which convey paint, atomizing air, propellant gas and electrical current to the gun; generally terminating either at the base of the grip, just above the grip or in front of the trigger location. The receptacle of the invention leaves these areas free and permits the attachment of any type of spray gun to the extension arm. It is particularly adapted to spray guns incorporating integral reservoirs for the paint to be sprayed, either of the externally supplied compressed air types or of the electrically driven integral, or airless, types.

The flexibility and adaptability of the sheathed cable control transmission permits ready adjustment to varying spray angle and to differing dimensions of the several guns which may be employed with the extension arm.

Such cable operators are generally known as Bowden cables and are admirably suited to the present purpose, length and adjustment, in particular, being simple and convenient when controlled through clamps slideable on the exposed cable itself.

BRIEF DESCRIPTION OF THE DRAWINGS

FIG. 1 is a side view of an extension arm of the invention mounting a spray gun of the integral paint container type;

FIG. 2 is a partial section of the embodiment of FIG. 1, taken along section line 2—2 in the latter, showing the joint between the extension arm stock and the receptacle-mounting arm;

FIG. 3 is a partial, isometric view of the paint spray gun receptacle and of the cable actuating mechanism; and FIG. 4 is a frontal elevation of the embodiment of FIG. 1, and of the attached spray gun, from the articulated joint of FIG. 2 upward, as defined by section line 4—4 in FIG. 1.

DESCRIPTION OF THE PREFERRED EMBODIMENT

The side view of FIG. 1 shows a spray gun extension arm assembly 100 whose main structural element is a stock 10. The stock 10 is an elongated tubular member of rectangular section which is held in a substantially vertical alignment during use. The lower extremity of the stock 10 is shaped into a butt 11 for ease of grip and is provided with an operating lever 16 protected by a guard 18. The operating lever is pivoted on a pin 17 and is provided with an extension for engaging one end of a sheathed operating cable 20.

The operating cable sheath 22 is anchored near the lever 16 and the cable 20 protrudes beyond the anchoring point and is held, after engagement with the aforementioned extension of the lever 16 by a cable end 24, suitable a swaged-on fitting permanently attached to the cable.

Both the cable 20 and its protective sheath 22 are flexible and are led upward through the inner volume of the stock 10, issuing outwardly therefrom, through a suitable opening in one sidewall, near the forward end 14 of the stock.

A swing head 30, a length of tubular material of smaller section than the stock 10 and adapted to fit thereinto, is pivoted to the stock by means of pivot pin 32 and secured by a wing nut 34. The details of the arrangement of the swing arm 30 with respect to the stock 10 are clearly illustrated in the sectional view of FIG. 2, a transverse section along line 2—2 of FIG. 1.

A paint spray gun 200 is mounted at the free end of swing head 30, encompassed by a receptacle formed of retainer plate 40 and grip holder 42. The spray gun 200 is of construction generally referred to as self-contained; the paint or other fluid medium to be dispensed therefrom is held in a container attached to the gun itself and only propellant air for conveying and atomizing the fluid is piped from an external source to the gun.

The spray gun 200 is fitted with a pistol grip 70, normally encompassed by the user's hand, with a trigger 60 and a projecting trigger guard 62. The trigger operates an air valve governing the admission of the compressed air to the gun, and, thereby, the amount of paint dispensed and the degree of atomization.

The practitioners of the spraying art will recognize that all manual paint spraying apparatus is provided with grips and triggers substantially similar to the pistol grip 70 and trigger 60 described with reference to the gun 200, independently of the actual design and method of operation of the apparatus.

The receptacle of the extension arm 100 will, therefore, accept substantially any spray gun that a user may desire to employ therewith. The method of attaching such a gun to the extension arm of the invention and operating it will be discussed with reference to FIGS. 3 and 4, in which the former is an isometric view of the swing head of the arm 100 showing in phantom outline the grip of a spray gun, while the latter is a frontal aspect showing the spray gun 200 mounted on the extension arm.

The grip retainer plate 40 is rigidly attached to the swing head 30 and is provided with an aperture, or window, 46 through which the trigger guard 62 protrudes when the grip 70 is brought into position against the plate 40. The grip holder 42 is pivoted on the shank of the swing head 30 and includes an angled tab 142 in such a manner that when the holder 42 is brought into the upright alignment shown in FIG. 3, it entraps the grip 70 against the swing head and against the faceplate 40. A thumb operated locktab 44 is also provided on the swing head and serves to lock the grip holder 42 into the upright alignment shown.

A bolt 43 is provided to act as the pivot on which the grip holder rotates to release a spray gun from the extension arm, or to permit another gun to be secured thereon.

The open position of the spray gun receptacle is attained by rotating the holder 42 in the direction of arrow "A" in FIG. 3, into the position outlined by a partial broken outline of that member.

FIG. 3 also illustrates the manner of actuating the trigger 60 of the gun 200, or an analogous control lever on another spray gun. A hinge pin 51 is socketed in an upward extension of the faceplate 40 and a hinge plate 50 depends from it. A spring 54 is entrapped between the outer surface of the plate 40 and the hinge plate 50 in such a manner that the latter is urged away from its limiting position, parallel and proximate to the former.

A trigger engagement pin 52 is affixed to the lower edge of the hinge plate 50 and extends into the plane of the spray gun grip receptacle, leftwardly in the illustration. The pin 52 is designed to replace the trigger finger of a manual operator and to occupy the same position athwart the trigger 60.

The upper end of the flexible cable sheath 22 is located in boss 26 and anchored by means of a screw 27; the cable 20 extends beyond the sheath and passes through an orifice drilled into the shank of trigger engagement pin 52. A cable stop 25, also equipped with a grip screw, is then placed over the end of th cable and adjusted until the hinge plate 50 brings the pin 52 against the trigger 60. Locking the cable and cable sheath in the recited positions will ensure that, upon actution of the operating lever 16, the pin 52 will be drawn against the force of spring 54 and will depress the trigger 60, thereby initiating and maintaining the flow of fluid from the spray gun 200.

The extension arm of the invention had been described with reference to the preferred embodiment thereof, changes in the detailed construction shall be deemed encompassed by the invention whose scope is delimited only by the appended claims.

The Inventor claims:

1. An extension arm for a spray painting device having a grip comprising:

an elongated stock, incorporating a pivotably mounted operating lever near one end thereof;

a locking receptacle attached to the other end of said stock, for receiving the spray device grip, said receptacle being defined by a stationary plate and a pivotable plate.

adjusting means for changing and securing angular relationship between said stock and said receptacle; and actuating means, including a projecting finger for engaging the control trigger of a paint spraying device received in said receptacle, spring means biasing said finger into the inoperative position of said control trigger, and sheathed, flexible cable means operably interconnecting said finger and said operating lever, whereby manually induced displacement of the operating lever is transmitted by said cable means to said finger and causes said control trigger to displace into the operative position, thereby initiating paint spray dispensing action of the paint spraying device.

2. The extension arm defined in Claim 1 wherein:

said stock is of tubular construction.

3. The extension arm of Claim 2 wherein:

said tubular stock is of rectangular section.

4. The extension arm of claim 1 wherein:

said cable means include a flexible, tubular sheath; a cable passing through said sheath and projecting from both ends thereof;

means for anchoring at least one end of said sheath, and engagement collars affixed near either end of said cable.

5. The extension arm of claim 4 wherein at least one of said collars is displaceable along said cable and lockable thereagainst.

6. An extension arm for spray painting devices, comprising:

an elongated stock, incorporating a pivotably mounted operating lever near one end thereof, a hinged, locking receptacle for painting spraying devices, pivotably attached to the other end of said stock, said receptacle including a swing arm pivoted on said stock, a faceplate projecting laterally from said swing arm, and a retainer clip pivotable on said swing arm toward said faceplate, whereby the grip of said spray painting device may be entrapped between said faceplate, said swing arm and said retainer clip, adjusting means for changing and securing angular relationship between said stock and said receptacle, and actuating means, including a projecting finger for engaging the control trigger of a paint spraying device received in said receptacle, spring means biasing said finger into the inoperative position of said control trigger, and sheathed, flexible cable means operably interconnecting said finger and said operating lever, whereby manually induced displacement of the operating lever is transmitted by said cable means to said finger and causes said control trigger to displace into the operative position, thereby initiating paint spray dispensing action of the paint spraying device.

7. The extension arm of claim 6, further comprising locking means for securing said retainer clip against said swing arm.

* * * * *